United States Patent [19]

Graziani et al.

[11] Patent Number: 4,648,957

[45] Date of Patent: Mar. 10, 1987

[54] LUBE HYDRODEWAXING METHOD AND APPARATUS WITH LIGHT PRODUCT REMOVAL AND ENHANCED LUBE YIELDS

[75] Inventors: Kenneth R. Graziani, Thorofare; Chwan P. Kyan, West Deptford, both of N.J.

[73] Assignee: Mobil Oil Corporation, New York, N.Y.

[21] Appl. No.: 685,564

[22] Filed: Dec. 24, 1984

[51] Int. Cl.[4] ..... C10G 65/10; C10G 65/12; C10G 69/12

[52] U.S. Cl. ..... 208/58; 208/59; 208/71; 208/97; 422/188; 422/211

[58] Field of Search ..... 208/59, 97, 58, 71; 585/502, 10, 18

[56] References Cited

U.S. PATENT DOCUMENTS

| | | | |
|---|---|---|---|
| Re. 28,398 | 4/1975 | Chen et al. | 208/111 |
| 3,663,423 | 5/1972 | Bennett et al. | 208/59 |
| 3,668,113 | 6/1972 | Burbidge et al. | 208/97 |
| 3,755,138 | 8/1973 | Chen et al. | 208/33 |
| 3,880,746 | 4/1975 | Bennett et al. | 208/59 |
| 3,956,102 | 5/1976 | Chen et al. | 208/93 |
| 3,960,978 | 6/1976 | Givens et al. | 260/683.15 R |
| 3,992,283 | 11/1976 | Hutchings | 208/111 |
| 4,021,502 | 5/1977 | Plank et al. | 260/683.15 R |
| 4,100,056 | 7/1978 | Reynolds | 208/57 |
| 4,100,218 | 7/1978 | Chen et al. | 208/67 |
| 4,150,062 | 4/1979 | Garwood et al. | 208/71 |
| 4,175,046 | 11/1979 | Coant et al. | 585/3 |
| 4,211,640 | 7/1980 | Garwood et al. | 208/255 |
| 4,227,992 | 10/1980 | Garwood et al. | 208/46 |
| 4,292,166 | 9/1981 | Gorring et al. | 208/97 |
| 4,300,006 | 11/1981 | Nelson | 585/16 |
| 4,370,219 | 1/1983 | Miller | 208/59 |
| 4,372,839 | 2/1983 | Oleck et al. | 208/59 |
| 4,383,913 | 5/1983 | Powell et al. | 208/59 |
| 4,400,265 | 8/1983 | Shen | 208/97 |
| 4,414,097 | 11/1983 | Chester et al. | 208/61 |
| 4,419,220 | 12/1983 | LaPierre et al. | 208/111 |
| 4,428,819 | 1/1984 | Shu et al. | 208/46 |
| 4,428,862 | 1/1984 | Ward et al. | 208/59 |
| 4,433,185 | 2/1984 | Tabak | 585/312 |
| 4,456,781 | 6/1984 | Marsh et al. | 585/533 |

*Primary Examiner*—Brian E. Hearn
*Assistant Examiner*—O. Chaudhuri
*Attorney, Agent, or Firm*—Alexander J. McKillop; Michael G. Gilman; Malcolm D. Keen

[57] ABSTRACT

An improved method and apparatus are disclosed for hydrodewaxing hydrocarbon feedstock, such as heavy distillate or residual feed. The feedstock is hydrodewaxed in a first step. The resulting first effluent is separated to form a first vapor stream containing olefinic products and a first liquid stream, with a pour point of about 30° to about 100° F. The first liquid stream is then introduced into a second catalytic reaction, where the first liquid stream is hydrodewaxed to a specification pour point less than about 30° F. The method and apparatus may also comprise routing primary products of hydrodewaxing, which contain olefins, as they are removed from the dewaxed first effluent, through an MOGDL unit to convert the olefins to additional high quality lubes. Improvements are due to removal of primary by-products containing olefins which inhibit dewaxing and accelerate catalyst aging and may cause reactor upsets. The addition of the MOGDL unit increases lube yields.

21 Claims, 5 Drawing Figures

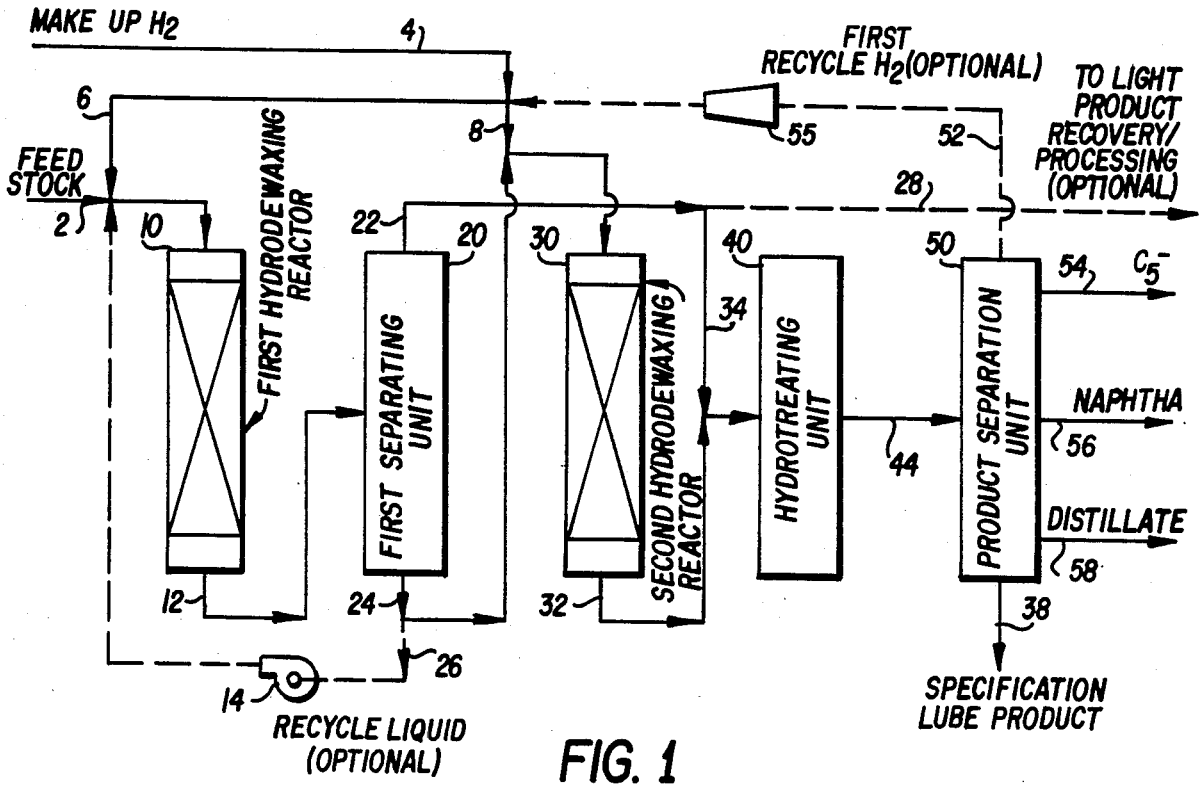
FIG. 1
FIG. 3
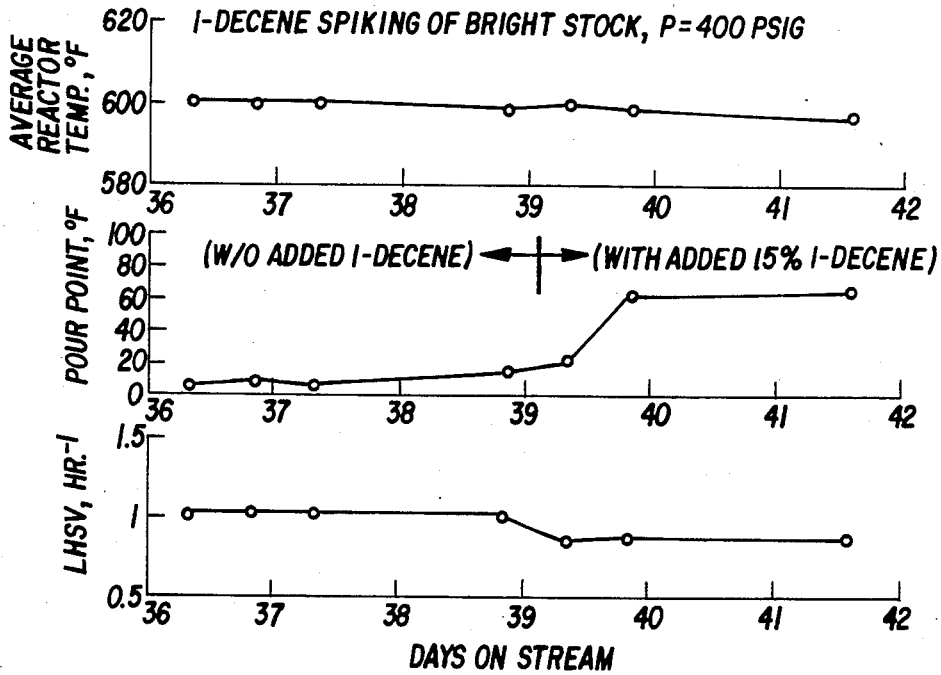

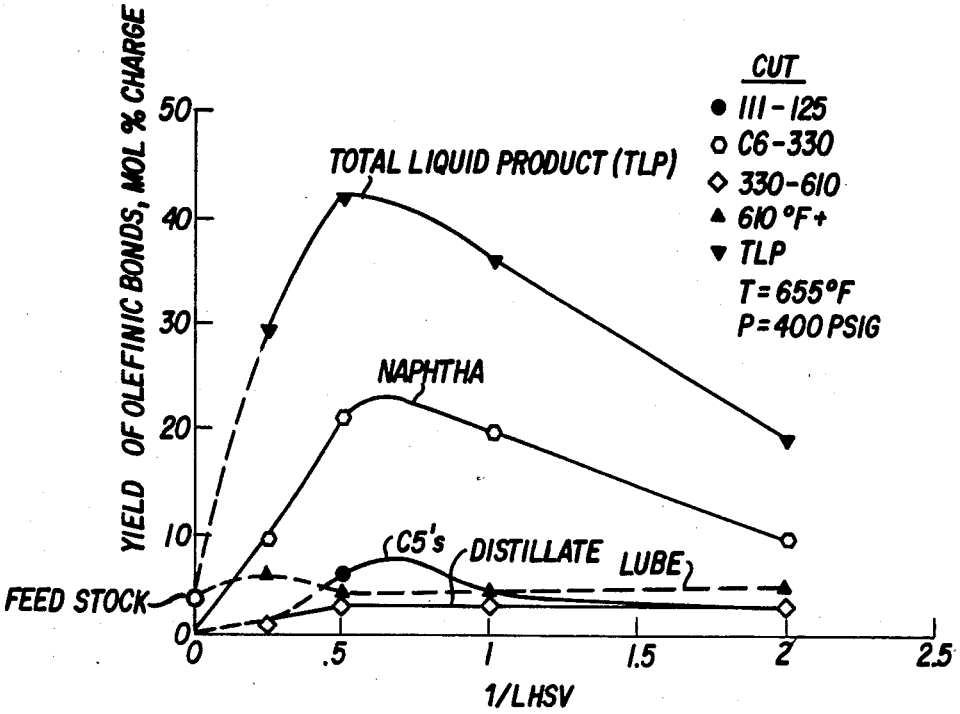
FIG. 4 OLEFINIC BOND YIELD LIGHT NEUTRAL FEEDSTOCK
FIG. 5
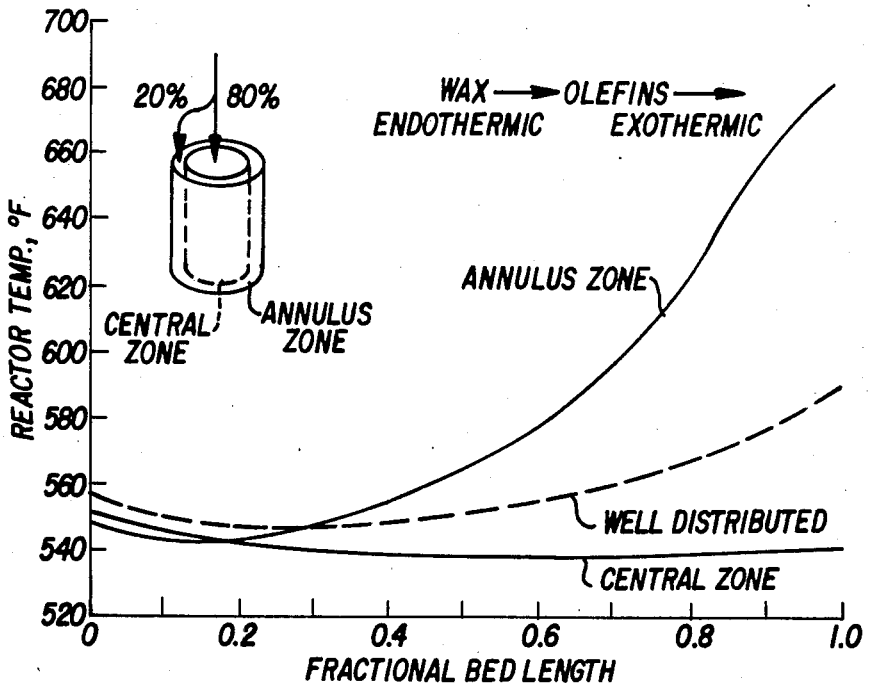

LUBE HYDRODEWAXING METHOD AND APPARATUS WITH LIGHT PRODUCT REMOVAL AND ENHANCED LUBE YIELDS

BACKGROUND OF THE INVENTION

1. Field of the Invention

This invention relates to methods and apparatuses for dewaxing heavy distillates and residual hydrocarbon liquids. More particularly, it relates to a method and apparatus for dewaxing heavy distillates and residual hydrocarbon liquids comprising multistage dewaxing and separation of a vapor stream between stages. It may also include catalytic oligomerization of the separated vapor stream to convert olefins in the vapor stream to gasoline, distillate and lube boiling range materials, and downstream units to hydrofinish and recover lubes.

2. Discussion of Prior Art

The dewaxing of hydrocarbons to liquids of lower pour point is a process of great commercial significance. Although alternatives exist, it is now evident that the use of shape-selective catalysts, such as ZSM-5 type catalysts, to selectively convert those paraffins that contribute the most to high pour points has many advantages over other methods. Thus, catalytic dewaxing over shape-selective zeolites will likely be the most commercially significant dewaxing process in the hydrocarbon processing industry.

Catalytic dewaxing of hydrocarbon oils to reduce the temperature at which precipitation of waxy hydrocarbons occurs is a known process and is described, for example, in the Oil and Gas Journal, Jan. 6, 1975, pages 69–73. A number of patents have also described catalytic dewaxing processes. For example, U.S. Pat. No. Re. 28,398 describes a process for catalytic dewaxing with a catalyst comprising a zeolite of the ZSM-5 type and a hydrogenation/dehydrogenation component. U.S. Pat. No. 3,956,102 describes a process for hydrodewaxing a gas oil with a ZSM-5 type catalyst. U.S. Pat. No. 4,100,056 describes a Mordenite catalyst containing a Group VI or Group VIII metal may be used to dewax a distillate from a waxy crude. U.S. Pat. No. 3,755,138 describes a process for mild solvent dewaxing to remove high quality wax from a lube stock, which is then catalytically dewaxed to specification pour point.

Catalytic dewaxing processes may be followed by other processing steps such as hydrodesulfurization and denitrogenation in order to improve the qualities of the product. For example, U.S. Pat. No. 3,668,113 describes a catalytic dewaxing process employing a Mordenite dewaxing catalyst which is followed by a catalytic hydrodesulfurization step over an alumina-based catalyst. U.S. Pat. No. 4,400,265 describes a catalytic dewaxing-/hydrodewaxing process using a ZSM-5 type catalyst wherein gas oil is catalytically dewaxed followed by hydrodesulfurization in a cascade system.

In catalytic dewaxing processes using shape-selective catalysts, such as a ZSM-5 type catalyst, the waxy components, particularly the n-paraffins, are cracked by the zeolite into lighter products containing olefinic material. However, these lighter products have a boiling point (b.p.) predominantly 610° F.−. Olefinic fragments are unstable to oxidation; so the dewaxed oil may be subsequently hydrogenated over catalysts to saturate the olefins and improve the oxidation stability of the oil. The hydrogenation catalysts generally used are mild hydrogenation catalysts, such as a $CoMo/Al_2O_3$ type.

The color of the oil may also be improved in this hydrofinishing process.

U.S. Pat. No. 4,428,819 to Shu et al discloses a process for hydrofinishing a catalytically dewaxed oil in which the residual wax content of the dewaxed oil is isomerized over a hydroisomerization catalyst. Typically, heavier lube fractions (greater than 610° F. b.p.) contain waxy components comprising normal paraffins, branched paraffins and cyclo paraffins. When a shape-selective catalyst, such as HZSM-5, is used to dewax these feeds, the normal paraffins crack much faster than the branched paraffins and cycloparaffins. HZSM-5 is a form of ZSM-5, with only hydrogen attached to the active sites, that is, no metals added.

Recent experience with ZSM-5 based catalytic dewaxing has shown that the dewaxing of higher boiling point or residual feeds (greater than 610° F. b.p.) pose significantly greater problems than that experienced with lighter distillate feeds.

Accelerated catalyst aging is particularly a problem for heavier feeds which cause catalysts to display a more rapid loss of activity relative to a fixed pour point specification (e.g., −7° C.). This loss of activity results in higher aging rates (°F./day by which the operating temperature of a dewaxing catalyst must increase to maintain desired conversion) and lower on-stream capacity factors.

It would be desirable to find a way to prolong hydrodewaxing catalyst activity at low cost.

Recent developments in zeolite catalysts and hydrocarbon conversion methods and apparatuses have also created interest in utilizing olefinic feedstocks for producing heavier hydrocarbons, such as $C_5$+ gasoline, distillates or lubes. These developments have contributed to the development of the Mobil olefins to gasoline/distillate (MOGD) method and apparatus, and the development of the Mobil olefins to gasoline/distillate/-lubes (MOGDL) method and apparatus.

In MOGD and MOGDL, olefins are catalytically converted to heavier hydrocarbons by catalytic oligomerization using an acid crystalline zeolite, such as a ZSM-5 type catalyst. Process conditions can be varied to favor the formation of either gasoline, distillate or lube range products. U.S. Pat. Nos. 3,960,978 and 4,021,502 to Plank et al disclose the conversion of $C_2$–$C_5$ olefins, alone or in combination with paraffinic components, into higher hydrocarbons over a crystalline zeolite catalyst. U.S. Pat. Nos. 4,150,062; 4,211,640; and 4,227,992 to Garwood et al have contributed improved processing techniques to the MOGD system. U.S. Pat. No. 4,456,781 to Marsh et al has also disclosed improved processing techniques for the MOGD system. U.S. Pat. No. 4,433,185 to Tabak teaches conversion of olefins in a two-stage system over a ZSM-5 or ZSM-11 type zeolite catalyst to form gasoline or distillate.

Olefinic feedstocks may be obtained from various sources, including from fossil fuel processing streams, such as gas separation units, from the cracking of $C_2$+ hydrocarbons, such as LPG (liquified petroleum gas), from coal by-products and from various synthetic fuel processing streams. U.S. Pat. No. 4,100,218 to Chen et al teaches thermal cracking of ethane to ethylene, with subsequent conversion of ethylene to LPG and gasoline over a ZSM-5 type zeolite catalyst.

The conversion of olefins in a MOGDL system may occur in a gasoline mode and/or a distillate/lube mode. In the gasoline mode, the olefins are catalytically oligomerized at temperatures ranging from 400°–800° F.

and pressures ranging from 10–1000 psia. To avoid excessive temperatures in an exothermic reactor, the olefinic feed may be diluted. In the gasoline mode, the diluent may comprise light hydrocarbons, such as $C_3$–$C_4$, from the feedstock and/or recycled from debutanized oligomerized product. In the distillate/lube mode, olefins are catalytically oligomerized to distillate at temperatures ranging from 350°–600° F. and pressures ranging from 100–3000 psig. The distillate is then upgraded by hydrotreating and separating the hydrotreated distillate to recover lubes.

Although lubes can be produced from olefins by the prior art, MOGDL and catalytic hydrodewaxing were not combined because the types (by b.p. distribution) of olefins in hydrodewaxed stock were not known so the hydrodewaxed stock was hydrotreated to saturate any olefins rather than recover them.

SUMMARY OF THE INVENTION

By way of background, some of the reasons why catalysts age have now been discovered. Specifically, it is found that olefinic intermediates (primary by-products) which are by-products of the catalytic hydrodewaxing reaction have the following effects. First, they significantly inhibit the hydrodewaxing reaction. Second, they occur predominantly in the distillate and lighter fraction in sizeable quantity. Third, they can cause an uncontrolled reactor behavior such as temperature runaway.

These findings have suggested new methods and apparatuses for substantially improved hydrodewaxing of hydrocarbon feeds, which forms the present invention described below. The invention removes the olefinic intermediate products as they are formed during the course of the hydrodewaxing reaction, simultaneously enhances the hydrodewaxing catalyst activity and ensures a controlled reactor behavior. The enhanced activity gives a lower start-of-cycle temperature and a larger operating temperature span, thereby resulting in longer catalyst cycle life.

The invention may also remove the olefinic intermediates as they are formed during the course of the hydrodewaxing reaction and routing them through a MOGDL unit to catalytically oligomerize them into additional low pour point high quality lube. Combining catalytic hydrodewaxing the MOGDL simultaneously enhances the hydrodewaxing catalyst activity, increases the lube yield and ensures a controlled reactor behavior. Furthermore, blending of the low pour MOGDL lube into the main lube product stream reduces the requirement of hydrodewaxing severity to meet a given target pour point.

Prior to the present invention, it was not known that the distribution of olefins in the intermediate products placed most of the olefins in the distillate and lighter non-lube fractions so olefins were not recovered to be available for MOGDL. Rather, in the prior art, all the effluent from catalytic hydrodewaxing was fed to a hydrotreater to saturate the olefins.

Accordingly, a primary object of the invention is to provide a method and apparatus for catalytically hydrodewaxing a hydrocarbon feed using a first hydrodewaxing reactor, followed by separating the first effluent from the first reactor into a first vapor stream and a first liquid stream, and feeding the first liquid stream to a second hydrodewaxing reactor where hydrodewaxing to desired product specification is achieved.

Another object of the invention is to provide a method and apparatus for hydrodewaxing a hydrocarbon feed in a first reactor to obtain a first liquid stream having an intermediate pour point of about 30° F. to about 100° F. (−1° to 38° C.) and hydrodewaxing the first liquid stream to obtain a second liquid stream having a pour point less than about 30° F. (−1° C.).

Another object of this invention is to provide a method and apparatus for multi-stage reactor hydrodewaxing of a hydrocarbon feed with separation of an effluent from each reactor into a liquid stream and a vapor stream and catalytically oligomerizing olefins in the vapor stream in an MOGDL unit to obtain a lube stream.

The method of this invention comprises the steps of catalytically hydrodewaxing a hydrocarbon feedstock under conditions sufficient to produce a first effluent stream having an intermediate pour point of about 30° F. to about 100° F. (−1° to 38° C.), wherein said first effluent stream comprises olefins; separating the first effluent stream to obtain a first vapor stream and a first liquid stream, wherein said first vapor stream comprises a portion of the olefins; and catalytically hydrodewaxing the first liquid stream under conditions sufficient for producing a second effluent stream having a pour point less than about 30° F. (−1° C.).

More particularly, the method of this invention comprises the steps of:

(a) catalytically hydrodewaxing a hydrocarbon feedstock at a temperature in the range from about 500° to about 675° F., a pressure from about 350 to about 650 psig, and a hydrogen feed rate from about 1500 to about 4000 SCF/bbl of the feedstock to produce a first effluent stream having an intermediate pour point of about 50° to about 70° F.;

(b) separating the first effluent stream to obtain a first vapor stream comprising 610° F.− b.p. hydrocarbons, a portion of which are olefinic and obtain a first liquid stream comprising hydrocarbons having an initial boiling point ranging from 610° to 800° F.;

(c) catalytically hydrodewaxing the first liquid stream at a temperature in the range from about 500° to about 675° F., a pressure from about 350 to about 650 psig and a hydrogen feed rate from about 1500 to about 4000 SCF/bbl of the first liquid stream to produce a second effluent stream having a pour point less than about 20° F. (−7° C.);

(d) hydrotreating the second effluent stream to produce a hydrotreating effluent stream and separating the hydrotreated effluent stream to form a lube product;

wherein the overall space velocity for the feedstock hydrodewaxing the first liquid stream hydrodewaxing steps is from 0.5 to about 1.0 $hr^{-1}$ LHSV and the ratio of space velocity for hydrodewaxing the feedstock to hydrodewaxing the first liquid stream is from about 3:7 to about 7:3; and wherein the feedstock dewaxing step and the first liquid stream hydrodewaxing steps comprise contacting the respective streams with respective crystalline zeolite dewaxing catalysts having the structure of at least one zeolite from the group consisting of ZSM-5 and Zeolite Beta.

The apparatus of this invention comprises:

means for catalytically hydrodewaxing a hydrocarbon feedstock under conditions sufficient to produce a first effluent stream having an intermediate pour point of about 30° to about 100° F. (−1° to 38° C.);

means for separating the first effluent stream to obtain a first vapor stream and a first liquid stream; and means for catalytically hydrodewaxing the first liquid stream under conditions sufficient for producing a second effluent stream having a pour point less than about 30° F. (−1° C.).

More particularly, the apparatus of this invention comprises:

(a) means for catalytically hydrodewaxing the feedstock at a temperature in the range from about 500° to about 675° F., a pressure from about 350 to about 650 psig, and a hydrogen feed rate from about 1500 to about 4000 SCF/bbl of the feedstock to produce a first effluent stream having an intermediate pour point of about 50° to about 70° F.;

(b) means for separating the first effluent stream to obtain a first vapor stream comprising 610° F.− b.p. hydrocarbons, a portion of which are olefinic and to obtain a first liquid stream comprising hydrocarbons having an initial boiling point ranging from 610° to 800° F.;

(c) means for catalytically hydrodewaxing the first liquid stream at a temperature in the range from about 500° to about 675° F., a pressure from about 350 to about 650 psig, and a hydrogen feed rate from about 1500 to about 4000 SCF/bbl of the first liquid stream to produce a second effluent stream having a pour point less than about 20° F. (−7° C.);

(d) means for hydrotreating the second effluent stream to produce a hydrotreating effluent stream and separating the hydrotreated effluent stream to form a lube product;

wherein the means for feedstock hydrodewaxing and the means for first liquid stream hydrodewaxing have an overall space velocity from about 0.5 to about 1.0 $hr^{-1}$ LHSV and the ratio of space velocity for hydrodewaxing said feedstock to the space velocity of hydrodewaxing said first liquid stream is about 3:7 to about 7:3; and wherein the means for feedstock dewaxing and the means for first liquid stream hydrodewaxing are means for contacting said respective streams with respective crystalline zeolite dewaxing catalysts having the structure of at least one zeolite from the group consisting of ZSM-5 and Zeolite Beta.

The hydrodewaxing in the first and second reactors occurs under conditions which include a temperature in the range from about 400° to about 800° F. (204° to 427° C.), preferably about 500° to about 675° F. (260° to 357° C.), a pressure in the range from about 100 to about 2000 psig (8–139 bars), preferably about 350 to about 650 psig (25–46 bars). The hydrogen feed rate to the first reactor is in the range from about 500 to about 100,000 SCF/bbl of feedstock, preferably about 1500 to about 4000 SCF/bbl. The hydrogen feed rate to the second reactor is in the range from about 1500 to about 100,000 SCF/bbl of the first liquid stream, preferably about 1500 to about 4000 SCF/bbl. The overall Liquid Hourly Space Velocity (LHSV) of the first and second hydrodewaxing reactors is in the range from about 0.25 to about 4 $hr^{-1}$, preferably about 0.5 to about 1.0 hr−. LHSV represents ($ft^3$/hr of reactant) per ($ft^3$ of catalyst) and the reactants are the feedstock and the first liquid stream to the respective reactors.

The ratio of space velocity for hydrodewaxing the feedstock to hydrodewaxing the liquid stream is in the range from about 1:9 to about 9:1 and preferably about 3:7 to about 7:3.

The invention may also comprise feeding vapor streams separated from the hydrodewaxing effluents to an MOGDL unit to catalytically oligomerize the olefins in the vapor stream thereby obtaining a lube stream.

Catalytic oligomerization of the olefins in the vapor streams occurs under conditions which include temperatures in the range from about 350° to about 600° F. (177° to 316° C.), pressures in the range from about 100 to about 3000 psig (8 to 208 bars), preferably about 800 to about 2000 psig (56 to 139 bars), and Weight Hourly Space Velocity (WHSV) in the range from about 0.1 to about 5.0 $hr^{-1}$. WHSV represents (lb/hr of reactant) per (lb catalyst), wherein the reactants are the vapor streams. In MOGDL the olefins may contact a crystalline zeolite catalyst having a Constraint Index of about 1 to about 12.

BRIEF DESCRIPTION OF THE DRAWINGS

FIG. 1 is a block flow diagram of an embodiment of the invention showing a first hydrodewaxing reactor, a first separating unit and a second hydrodewaxing reactor;

FIG. 3 is a plot of pilot plant dewaxing data showing the inhibition effect of olefins on hydrodewaxing catalysts;

FIG. 4 is a plot of olefinic contents of the various product cuts obtained from hydrodewaxing of light neutral stock versus 1/LHSV velocity; and FIG. 5 is a plot of temperature profile in a simulated catalytic hydrodewaxing reactor versus fractional bed length.

PREFERRED EMBODIMENTS OF THE INVENTION

Figure 2:
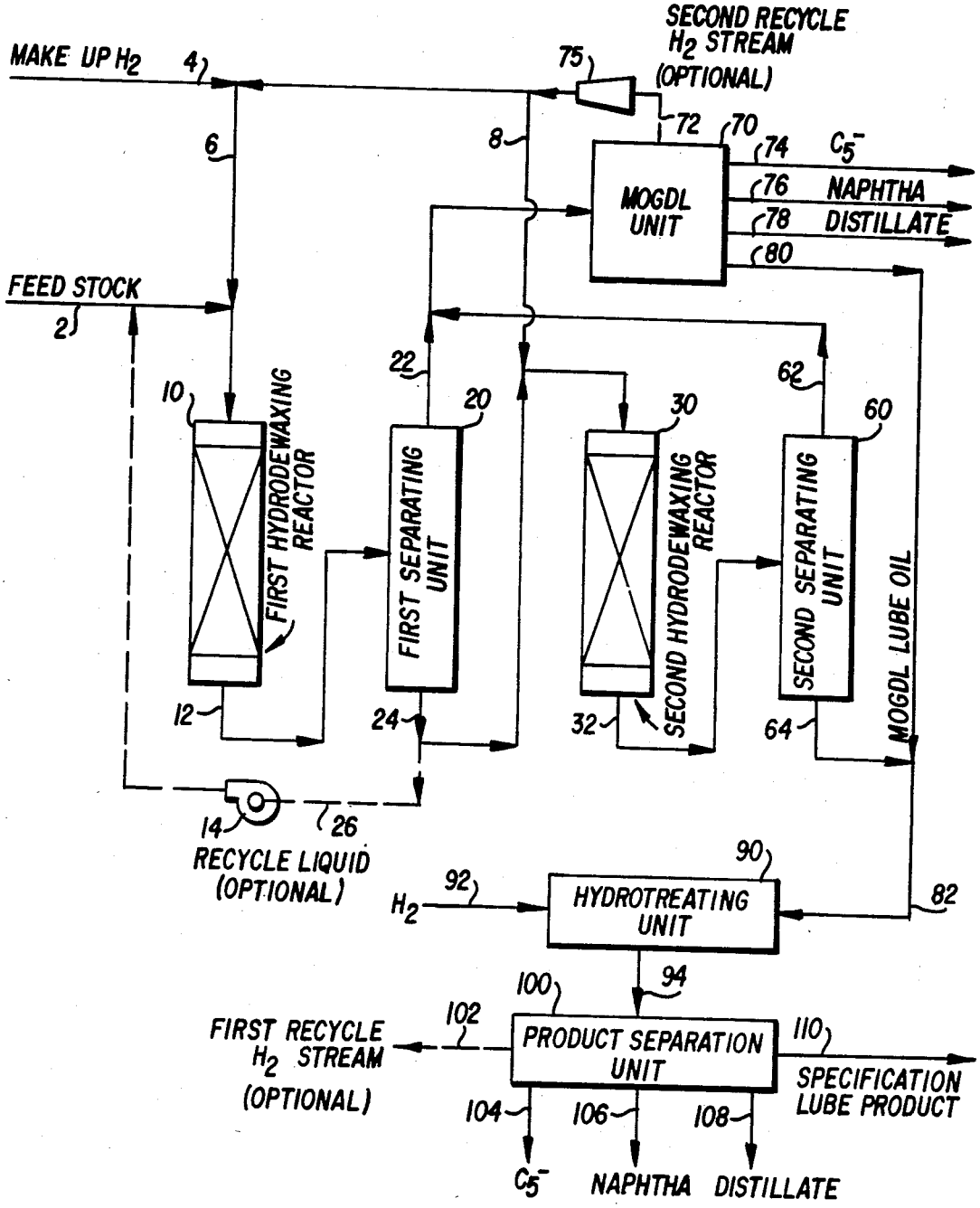
FIG. 2 shows a block flow diagram of a second embodiment of the invention showing a first hydrodewaxing reactor, a first separating unit, a second hydrodewaxing reactor, a second separating unit and a MOGDL unit.

The present process is applicable to feedstocks, including lube stocks, when a low wax content is desired in the final product. The feedstocks may comprise hydrocarbons having a 400° F.+ b.p. (boiling point), particularly those having a 610° F.+ b.p. The feeds may be virgin or prefractionated hydrocarbons.

The method of the apparatus is carried out at elevated pressure and temperature, along with suitable space velocity and hydrogen feed rates. A waxy feedstock 2, as shown in FIG. 1, with a pour point greater than about 80° F. passes through a preheater (not shown) and contacts a hydrodewaxing catalyst contained in a first hydrodewaxing reactor 10. The first hydrodewaxing reactor 10 operates at a temperature in the range from about 400° to about 800° F. (204° to 427° C.), preferably about 500° to about 675° F. (260° to 357° C.), a pressure from about 100 to about 2000 psig (8 to 139 bars), preferably about 350 to about 650 psig (25 to 46 bars), and a hydrogen feed rate from about 500 to about 100,000 SCF/bbl of feedstock 2, preferably about 1500 to about 4000 SCF/bbl. Hydrogen is provided to the first reactor 10 by combining a first portion 6 of make up $H_2$ stream 4 and an optional first recycle $H_2$ stream 52 with the feedstock 2. The first hydrodewaxing reactor 10 catalytically hydrodewaxes the feedstock 2 by cracking a portion of the feedstock to obtain lighter products, such as $C_4$− gases and light paraffinic and olefinic fragments, some of which remain in the lube oil boiling range (610°

F.+ b.p.), but most of which have boiling points less than the lube oil boiling range.

A first effluent stream 12 passes from the first hydrodewaxing reactor 10 to a first separating unit 20. The separating unit 20 separates the first effluent stream 12 into a first vapor stream 22 and a first liquid stream 24. The separation is accomplished by a high pressure separator at system pressure or by lowering the pressure and flashing the first effluent stream 12 or by distilling the first effluent stream 12. The separation removes those materials boiling below 330° F., and preferably has a higher cut point of at least 610° F., depending upon the composition of the feedstock 2. For example, the typical cut points for light neutral, heavy neutral, and bright stock are 610° F., 650° F., and 800° F., respectively. Due to the catalytic hydrodewaxing of the feedstock 2, the first effluent stream 12 will have an intermediate pour point of about 30° to about 100° F. (−1° to 38° C.), preferably about 50° to about 70° F. (10° to 21° C.). The composition of the first liquid stream 24 and the first vapor stream 22 can be adjusted, depending upon the final product specification desired, by adjusting the temperature and pressure in the first separating unit 20. Generally, the pour point of the first effluent stream 12 will be about the same as that of first liquid stream 24.

The first vapor stream 22 may be sent to downstream processing for light product recovery while the first liquid stream 24 passes into the second hydrodewaxing reactor 30 where it contacts with catalyst. The reactor 30 operates at a temperature from about 400° to about 800° F. (204° to 427° C.), preferably 500° to about 675° F. (260° to 357° C.), a pressure from about 100 to about 2000 psig (8 to 140 bars), preferably about 350 to about 650 psig (25 to 46 bars), and a hydrogen feed rate from about 500 to about 100,000 SCF/bbl of the first liquid stream 24, preferably about 1500 to about 4000 SCF/bbl. Hydrogen is provided to the second reactor 30 by combining a second portion 8 of the make up $H_2$ stream 4 and optional the first recycle $H_2$ stream 52 with first liquid stream 24. The overall Liquid Hourly Space Velocity (LHSV) of the first and second hydrodewaxing reactors 10, 30 ranges from about 0.25 to about 4 $hr^{-1}$, preferably about 0.25 to about 1.0 $hr^{-1}$. Overall LHSV represents ($ft^3$/hr of reactants) per ($ft^3$ of catalyst) in the reactors 10, 30. The reactants are the feedstock 2 and the first liquid stream 24 to the respective reactors 10, 30. The ratio of LHSV for the reactor 10 for hydrodewaxing the feedstock to that of the reactor 30 for hydrodewaxing the liquid stream ranges from about 1:9 to about 9:1, and preferably about 3:7 to about 7:3. In both hydrodewaxing reactors 10, 30 the hydrocarbons contact a crystalline zeolite catalyst as discussed below.

In the second hydrodewaxing reactor 30, the first liquid stream 24 is catalytically hydrodewaxed to produce a second effluent stream 32 having a pour point less than about 30° F. (−1° C.), preferably less than about 20° F. (−7° C.). The second effluent stream 32 is then hydrotreated and separated, as described below, to produce a lube product stream 38. The hydrotreating is accomplished by feeding the second effluent stream 32 and an optional stream 34 to a hydrotreating unit 40 to saturate olefins. Generally, the pour point of the second effluent stream 32 will be about the same as that of the product stream 38.

The first vapor stream 22 may either form stream 34 and be combined with second effluent stream 32 and sent to the hydrotreating unit 40, or stream 22 may be sent to light product recovery/processing (not shown) as stream 28. Stream 22 contains olefins and may be sent to the hydrotreating unit 40 as stream 34 if it is desired to saturate these olefins. However, stream 28 may be sent to light product recovery/processing if it is desired to recover or process the olefins. Hydrogen is provided to the unit 40 by stream 32 which contains unconsumed hydrogen from stream 8. Hydrotreating will be discussed in more detail below.

The streams to be upgraded are preferably stabilized by being subjected to hydrotreating to saturate olefins and diolefins contained therein and to increase the cetane value of any distillate produced. Hydrogen gas may be obtained by sources such as steam reforming. Hydrotreating is a catalytic process which preferably employs a cobalt-molybdenum or nickel-tungsten containing catalyst. Saturation of the olefin double bond is essentially complete under hydrogenation conditions of about 500° to about 700° F. (260° to 371° C.), a pressure of about 100 to about 500 psig (8 to 36 bars), a space velocity of about 0.5 to about 5.0 LHSV (Liquid hourly space velocity), and a hydrogen feed rate of about 1000 to about 5000 SCF/bbl. Hydrotreating generally does not significantly affect pour point of the lube product.

A hydrotreating effluent stream 44 passes to a product separation unit 50 which separates the hydrotreating effluent stream 44 into a $C_5^-$ stream 54, naphtha stream 56, distillate stream 58, specification lube product 38 and optionally the first recycle hydrogen stream 52, which may pass through first recycle compressor 55 and combine with makeup hydrogen stream 4.

Another option is to separate a recycle liquid stream 26 from the first liquid stream 24. The recycle liquid stream 26 passes through a first recycle pump 14 and is combined with the feedstock 2 for recycle back to the first hydrodewaxing reactor 10. The recycle liquid stream 26 reduces the olefinic partial pressure inside the first hydrodewaxing reactor 10 and minimizes secondary olefinic reactions.

It should be understood that the first and second hydrodewaxing reactors 10, 30 are shown as each having one reactor; however, they may each actually comprise a plurality of reactors in parallel or in series, or each may comprise a catalyst bed in the same reactor vessel. Furthermore, greater than two reactors in series with interstage separation may be employed for dewaxing.

Fixed bed reactors are suitable for this invention. However, other reactor types, such as continuous stirred tank reactors (CSTR), slurry reactors, etc., may be employed.

The advantages of the embodiment of FIG. 1 include removal of the primary reaction by-products produced during the cracking of waxes in a feedstock. It was found that the primary reaction by-products contain olefins and other light (less than 610° F. b.p.) products which can inhibit hydrodewaxing catalyst activity. Dewaxing is endothermic; however, hydrogenation of the olefinic gas phase is exothermic. The hydrogenation within a hydrodewaxing reactor can lead to a temperature rise of 130° F. or, in the worst case, temperature runaways. This large temperature rise would decrease the lube yield and degrade the lube product. Removing the light primary by-products, as the vapor stream from the first separating unit 20, reduces the gas phase in subsequent hydrodewaxing reactors and removes the olefins before they can hydrogenate. This provides a more controllable reactor with greatly reduced potential for temperature runaway.

FIG. 2 shows a second embodiment of the invention in which the second effluent stream 32 passes to a second separating unit 60. The second separating unit 60 operates within a similar range of operating conditions as the first separating unit 20 discussed above. The second separating unit 60 separates the second effluent stream 32 into a second vapor stream 62 and a second liquid stream 64. The separating unit 60 removes those materials boiling below 330° F., and preferably has a higher cut point of at least 610° F. The first vapor stream 22 and second vapor stream 62 are combined and pass into a MOGDL unit 70. Operating parameters for MOGDL unit 70 are described in more detail below. The streams 22, 62 contain a high proportion of light (less 610° F. b.p.) olefins which are converted in the MOGDL unit 70 by catalytic oligmerization to form heavier hydrocarbons, which include lube range hydrocarbons. MOGDL unit 70 also contains separation facilities to separate the product of catalytic oligmerization into a second $C_5-$ stream 74, a second naphtha stream 76, a second distillate stream 78, a MOGDL lube oil stream 80 and, optionally, a second recycle hydrogen stream 72. The second recycle hydrogen stream 72 may be compressed by second recycle compressor 75 and combined with makeup hydrogen stream 4 for recycle to the first and second hydrodewaxing reactors 10, 30. MOGDL lube oil stream 80 may be combined with the second liquid stream 64 to form combined stream 82, which passes to hydrotreating unit 90 where it is combined with hydrogen provided by a hydrogen stream 92 to form hydrotreating effluent stream 94. Stream 94 passes to product separation unit 100, where it is separated into a first $C_5-$ stream 104, a first naphtha stream 106, a first distillate stream 108, a specification lube product stream 110 and, optionally, a first recycle hydrogen stream 102 which may be combined with make up hydrogen stream 4.

General operating parameters for production of lube boiling range materials (610° F.+ b.p.) in the MOGDL unit 70 include pressures from about 100 to about 3000 psig (8 to 208 bars), preferably about 800 to about 2000 psig (56 to 139 bars), temperatures ranging from about 350° C. to about 600° F. (177° to 316° C.), and Weight Hourly Space Velocities of about 0.1 to about 5 WHSV. WHSV represents (lbs reactants/hr) per (lb catalyst). Conversion of olefins to heavier products, such as distillates, is typically greater than 90%. A suitable system for conversion of olefins to heavier hydrocarbons and upgrading of the heavier hydrocarbons by hydrotreating and separation to recover lube oil is described in more detail in U.S. Pat. No. 4,413,153 (Garwood et al).

The advantages of the second embodiment include enhanced dewaxing catalyst activity and slower catalyst aging rate due to a lower light olefin partial pressure. A less severe dewaxing is required to meet the same target pour point due to the effect of blending low pour MOGDL lube product and the main lube product. A lower dewaxing catalyst cycle length is accomplished due to the lower start of cycle temperature and therefore greater operating temperature span resulting from the less severe dewaxing requirements. The less severe dewaxing requirements result in a higher lube yield for the same target pour point. Lowering the olefin partial pressure results in a more controllable reactor with reduced potential of temperature runaway. In addition, hydrogen requirements are reduced for subsequent lube hydrotreating because olefinic light material is removed prior to the hydrotreating.

Catalysts

The catalysts employed in the first and second hydrodewaxing reactors 10, 30 may be the same type or different. However, they will possess shape-selective paraffin cracking ability. Catalysts that have shape-selective qualities include crystalline zeolite catalysts and crystalline silica alumina phosphate (SAPO) catalysts. These materials may be bound in a variety of matrices, such as those containing silica and alumina or silica and alumina alone. The catalysts may contain up to 15% metals that are known to possess a hydrogenation ability. The preferred hydrogenation components are the noble metals of Group VIII, especially platinum and palladium, but other noble metals, such as iridium, ruthenium or rhodium, may also be used. Combinations of noble metals with non-noble metals, such as nickel, rhenium, tungsten, chromium and molybdenum are of interest. Combinations of Group VIB and Group VIII are also of interest. Base metal hydrogenation components may also be used, especially nickel, cobalt, molybdenum, tungsten, copper or zinc.

The metal may be incorporated into the catalyst by any suitable method such as impregnation or exchange onto the zeolite. The metal may be incorporated in the form of a cationic, anionic or a neutral complex, such as $Pt(NH_3)_4{}^{2+}$, and cationic complexes of this type will be found convenient for exchanging metals onto a zeolite. Anionic complexes are also useful for impregnating metals into the zeolites.

The invention is effective for improving the hydrodewaxing performance of intermediate pore or large pore zeolites, which are described below, because the invention removes olefinic primary products which are believed to inhibit the hydrodewaxing activity of most hydrodewaxing catalysts.

A portion of the novel class of zeolites useful for hydrodewaxing are termed medium or intermediate pore zeolites and are characterized by an effective pore size of generally less than about 7 angstroms, and/or pore windows in a crystal formed by 10-membered rings. The medium or intermediate pore zeolites are represented by those zeolites having the structure of ZSM-5, ZSM-11, ZSM-23, ZSM-35, ZSM-38, ZSM-48 and TMA (tetra methyl ammonium) Offretite.

By "intermediate pore size zeolite", as used herein, is meant zeolites having the unique characteristic of being able to differentiate between large molecules and molecules containing quaternary carbon atoms on the one hand, and smaller molecules on the other hand. Thus, the intermediate pore size materials have surprising catalytic activity and stability when compared to most of the larger pore size crystalline zeolites.

By "intermediate pore size", as used herein, is meant an effective pore aperture preferably in the range of about 5 to 6.5 Angstroms when the molecular sieve is in the H-form. Zeolites having pore apertures in this range tend to have unique characteristics and to be particularly useful in dewaxing. Unlike small pore size zeolites, such as erionite and chabazite, they will allow hydrocarbons having some branching into the molecular sieve void spaces. Unlike larger pore size zeolites, such as the faujasites, they can differentiate between n-alkanes and slightly branched alkanes on the one hand and larger branched alkanes having, for example, quaternary carbon atoms.

The effective pore size of zeolites can be measured using standard adsorption techniques and compounds of known minimum kinetic diameters. See Breck, *Zeolite Molecular Sieves,* 1974 (especially Chapter 8), and Anderson et al, *J. Catalysis* 58, 114 (1979), both of which are incorporated herein by reference.

Intermediate pore size zeolites in the H-form will typically admit molecules having kinetic diameters of 5.0 to 6.5 Angstroms with little hindrance. Examples of such compounds (and their kinetic diameters in Angstroms) are n-hexane (4.3), 3-methylpentane (5.5), benzene (5.85), and toluene (5.8). Compounds having kinetic diameters of about 6 to 6.5 Angstroms can be admitted into the pores, depending on the particular sieve, but do not penetrate as quickly and, in some cases, are effectively excluded. Compounds having kinetic diameters in the range of 6 to 6.5 Angstroms include: cyclohexane (6.0), 2,3-dimethylbutane (6.1), m-xylene (6.1), and 1,2,3,4-tetramethylbenzene (6.4). Generally, compounds having kinetic diameters of greater than about 6.5 Angstroms do not penetrate the pore apertures, and thus are not absorbed into the interior of the zeolite lattice. Examples of such larger compounds include: hexamethylbenzene (7.1), 1,3,5-trimethylbenzene (7.5), and tributylamine (8.1).

In performing adsorption measurements to determine effective pore size, standard techniques are used. It is convenient to consider a particular molecule as excluded if it does not fill at least 80% of the zeolite pore volume in less than about one hour (p/po=0.5; 25° C.)

The acid activity of zeolite catalysts is conveniently defined by the alpha scale described in an article published in *Journal of Catalysis,* Vol. VI, pp. 278–287 (1966). In this text, the zeolite catalyst is contacted with hexane under conditions presecribed in the publication, and the amount of hexane which is cracked is measured. From this measurement is computed an "alpha" value which characterizes the catalyst for its cracking activity for hexane. The entire article above referred to is incorporated herein by reference. The alpha scale so described will be used herein to define activity levels for cracking n-hexane. And, in particular, for purposes of this invention, a catalyst with an alpha value of not greater than about 1.0, and preferably not greater than about 0.5, will be considered to have substantially no activity for cracking hexane.

Another class of zeolites useful for hydrodewaxing are termed large pore zeolites and have a pore size larger than the medium pore zeolites and sufficiently large to admit the vast majority of components normally found in a feedstock. These zeolites generally are stated to have a pore size in excess of 7.5 angstroms and/or formed by 12-membered rings. The large pore zeolites are represented by ZSM-4, ZSM-12, ZSM-20, Zeolite Beta, Mordenite, TEA (tetra ethyl ammonium) Mordenite, Dealuminized Y, and Rare Earth Y. Additionally, the large pore component may include a low sodium Ultrastable Y molecular sieve (USY). Generally, with the exception of Zeolite Beta, the large pore zeolites have less hydrodewaxing effectiveness than the intermediate pore zeolites.

ZSM-4 is more particularly described in U.S. Pat. No. 3,923,639.

ZSM-5 is more particularly described in U.S. Pat. No. 3,702,886 and No. Re. 29,948.

ZSM-11 is more particularly described in U.S. Pat. No. 3,709,976.

ZSM-12 is more particularly described in U.S. Pat. No. 3,832,449.

ZSM-20 is more particularly described in U.S. Pat. No. 3,972,983.

ZSM-23 is more particularly described in U.S. Pat. No. 4,076,842.

ZSM-35 is more particularly described in U.S. Pat. No. 4,016,245.

ZSM-38 is more particularly described in U.S. Pat. No. 4,046,859.

ZSM-48 is more particularly described in U.S. Pat. No. 4,397,827.

Zeolite Beta is more particularly described in U.S. Pat. No. 3,308,069 and No. Re. 28,341.

USY is more particularly described in U.S. Pat. Nos. 3,293,192 and 3,449,070.

The oligomerization catalysts preferred for use herein include crystalline alumina silicate zeolites having a silica-to-alumina ratio of at least 12, a Constraint Index of about 1 to 12 and acid cracking activity of about 160–200. Representative of suitable type zeolites are ZSM-5, ZSM-11, ZSM-12, ZSM-23, ZSM-35 and ZSM-38. A suitable shape selective catalyst for a fixed bed reactor is an HZSM-5 zeolite with alumina binder in the form of cylindrical extrudates of about 1–5 millimeters. HZSM-5 is a ZSM-5 type catalyst with only hydrogen on the active catalyst sites and no metals on these sites. Other catalysts which may be used in one or more reactor stages include siliceous materials with pore size in the range of 5 to 9 Angstroms. These includes borosilicates, ferrosilicates and/or aluminosilicates, disclosed in U.S. Pat. Nos. 4,414,143 and 4,417,088.

Zeolites characterized by such Constraint Indices induce profound transformation of aliphatic hydrocarbons to aromatic hydrocarbons in commercially desirable yields and are generally highly effective in conversion reactions involving aromatic hydrocarbons. These zeolites retain a degree of crystallinity for long periods in spite of the presence of steam at high temperature, which induces irreversible collapse of the framework or other zeolites, e.g., of the X and A type. Furthermore, carbonaceous deposits, when formed, may be removed by burning at a higher than usual temperatures to restore activity. In many environments the zeolites of this class exhibit very low coke forming capability, conducive to very long times on stream between burning regenerations.

An important characteristic of the crystal structure of this class of zeolites is that it provides constrained access to, and egress from, the intracrystalline free space by virtue of having a pore dimension greater than about 5 Angstroms and pore windows of about a size such as would be provided by 10-membered rings of oxygen atoms. It is to be understood, of course, that these rings are those formed by the regular disposition of the tetrahedra making up the anionic framework of the crystalline aluminosilicate, the oxygen atoms themselves being bonded to the silicon or aluminum atoms at the centers of the tetrahedra. Briefly, the preferred type zeolites useful in this invention possess a silica-to-alumina mole ratio of at least about 12, for oligomerization and catalytic dewaxing preferably in combination with a structure providing constrained access to the crystalline free space.

The zeolite will have a silica/alumina ratio of at least 12 for oligomerization and dewaxing. The desired low acid activity of the catalyst may be achieved by unusually high silica/alumina ratio, greater than 1000, preferably upwards of about 1500.

The silica-to-alumina ratio referred to may be determined by conventional analysis. This ratio is meant to represent, as closely as possible, the ratio in the rigid anionic framework of the zeolite crystal and to exclude aluminum in the binder or in cationic or other form within the channels. Such zeolites, after activation, acquire an intracrystalline sorption capacity for normal hexane which is greater than that for water, i.e., they exhibit "hydrophobic" properties. It is believed that this hydrophobic character is advantageous in the present invention.

The type zeolites described freely sorb normal hexane and have a pore dimension greater than about 5 Angstroms. In addition, the structure will preferably provide constrained access to larger molecules. It is sometimes possible to judge from a known crystal structure whether such constrained access exists. For example, if the only pore windows in a crystal are formed by 8-membered rings of oxygen atoms, then access by molecules of larger cross-section than normal hexane is excluded and the zeolite is not of the constrained type. Windows of 10-membered rings are preferred, although, in some instances, excessive puckering or pore blockage may render these zeolites ineffective. 12-membered rings do not generally appear to offer sufficient constraint to produce the advantageous conversions for oligomerization, although puckered structures exist, such as TMA offretite, which is a known effective zeolite. Also, structures can be conceived, due to pore blockage or other cause, that may be operative.

Rather than attempt to judge from crystal structure whether or not a zeolite possesses the necessary constrained access, a simple determination of the "Constraint Index" may be made by passing continuously a mixture of an equal weight of normal hexane and 3-methylpentane over a sample of zeolite at atmospheric pressure, according to the following procedure. A sample of zeolite, in the form of pellets or extrudate, is crushed to a particle size about that of coarse sand and mounted in a glass tube. Prior to testing, the zeolite is treated with a stream of air at 1000° F. for at least 15 minutes. The zeolite is then flushed with helium and the temperature adjusted between 550° and 950° F. to give an overall conversion between 10 and 60%. The mixture of hydrocarbons is passed at 1 liquid hourly space velocity (i.e., 1 volume of liquid hydrocarbon per volume of zeolite per hour) over the zeolite with a helium dilution to give a helium to total hydrocarbon mole ratio of 4:1. After 20 minutes on stream, a sample of the effluent is taken and analyzed, most conveniently by gas chromatography, to determine the fraction remaining unchanged for each of the two hydrocarbons.

The "Constraint Index" is calculated as follows:

$$\text{Constraint Index} = \frac{\log_{10}(\text{fraction of n-hexane remaining})}{\log_{10}(\text{fraction of 3-methyl pentane remaining})}$$

The Constraint Index approximates the ratio of the cracking rate constants for the two hydrocarbons. Preferred zeolites for oligomerization are those having a Constraint Index in the approximate range of 1 to 12. Constraint Index (CI) values for some typical zeolites at a temperature in the test range of 550° to 950° F. are:

| Zeolite | CI |
|---|---|
| ZSM-4 | 0.5 |
| ZSM-5 | 8.3 |
| ZSM-11 | 8.7 |
| ZSM-12 | 2 |
| ZSM-35 | 4.5 |
| ZSM-38 | 2 |
| TMA Offretite | 3.7 |
| Beta | 0.6 |
| H-Zeolon | 0.4 |
| REY | 0.4 |
| Amorphous Silica-Alumina | 0.6 |
| Erionite | 38 |

It is to be realized that the above Constraint Index values typically characterize the specified zeolites, but that such are the cumulative result of several variables used in determination and calculation thereof. Thus, for a given zeolite, depending on the temperatures employed within the aforenoted range of 550° to 950° F., with accompanying conversion between 10 and 60% for the above catalyst test, the Constraint Index may vary within the indicated approximate range of 1 to 12. Likewise, other variables, such as the crystal size of the zeolite, the presence of possible occluded contaminants and binders intimately combined with the zeolite, may affect the Constraint Index. It will accordingly be understood by those skilled in the art that the Constraint Index, as utilized herein, while affording a highly useful means for characterizing the zeolites of interest, is approximate, taking into consideration the manner of its determination, with probability, in some instances of compounding variable extremes.

While the above experimental procedure will enable one to achieve the desired overall conversion of 10 to 60% for most catalyst samples and represents preferred conditions, it may occasionally be necessary to use somewhat more severe conditions for samples for very low acid activity, such as those having a very high silica-to-alumina ratio. In those instances, a temperature of up to about 1000° F. and a liquid hourly space velocity of less than 1, such as 0.1 or less, can be employed in order to achieve a minimum total conversion of about 10% for the above catalyst test.

EXAMPLES

Laboratory tests, described below, were conducted on feedstocks comprising the properties listed in Tables 1 and 3:

TABLE 1

| | Bright Stock |
|---|---|
| API | 26° |
| Specific Gravity | 0.898 |
| Viscosity | |
| KV at 100° C. | 27.36 |
| KV at 300° F. | 8.63 |
| Aniline Point | 248 |
| Elemental Analysis, Wt. % | |
| Carbon | 85.6 |
| Hydrogen | 13.3 |
| Sulfur | 1.1 |
| Nitrogen (ppm) | 68 |
| Paraffins, wt % | 17.8 |
| Mono Naphthenes | 12.7 |
| Poly Naphthenes | 26.5 |
| Aromatics | 43.0 |
| MW | 750 |
| Flash Point | 554° F. |
| Bromine Number | 1.2 |
| Pour Point | 120° F. |

TABLE 1-continued

| Distillation Vol % | °F. |
|---|---|
| IBP | 833 |
| 5 | 939 |
| 10 | 977 |
| 20 | 1016 |
| 30 | 1044 |
| 40 | 1071 |
| 50 | 1097 |
| 60 | 1117 |
| 70 | — |
| 90 | — |
| 95 | — |

TABLE 2

| | | |
|---|---|---|
| Catalyst Particle Diameter, inch | 1/32 | 1/16 |
| Surface Area, $m^2$/gm | 357 | 341 |
| Real Density, gm/cc | 2.61 | 2.60 |
| Particle Density, gm/cc | 0.89 | 1.03 |
| Pore Volume, gm/cc | 0.739 | 0.585 |
| Pore Diameter, Angstroms | 83 | 69 |
| Alpha | 250 | 250 |
| Nickel, Wt % | 1.3 | 0.8 |
| Sodium, ppm | 190 | 190 |

TABLE 3

| | Light Neutral Stock |
|---|---|
| API | 30.6 |
| Specific Gravity | 0.873 |
| Viscosity | |
| KV at 100° C. | 5.558 |
| KV at 300° F. | 2.45 |
| KV at 40° C. | 30.61 |
| Aniline Point | 215 |
| Elemental Analysis, Wt. % | |
| Carbon | 85.4 |
| Hydrogen | 14.0 |
| Sulfur | 0.6 |
| Nitrogen (ppm) | 45 |
| Paraffins, wt % | 38.8 |
| Mono Naphthenes | 13.8 |
| Poly Naphthenes | 22.0 |
| Aromatics | 25.4 |
| MW | 480 |
| Flash Point | 428° F. |
| Bromine Number | 1.0 |
| Pour Point | 95° F. |
| Distillation Vol % | °F. |
| IBP | 745 |
| 5 | 792 |
| 20 | 816 |
| 30 | 826 |
| 40 | 836 |
| 50 | 844 |
| 60 | 853 |
| 70 | 865 |
| 80 | 879 |
| 90 | 899 |
| 95 | 912 |
| End Point | 942 |

EXAMPLE 1

Example 1 provides pilot plant data showing the inhibiting effect of olefins upon catalytic dewaxing activity and illustrates the importance of removing the olefins to enhance catalytic dewaxing by embodiments such as those illustrated in FIGS. 1 and 2. The tests were conducted in a 12" long, ⅞" inside diameter reactor, with a 100 cc volume to simulate a first reactor 10 at a pressure of 400 psig and a hydrogen feed rate of 2500 SCF/bbl using a bright stock, described by Table 1, as a feedstock 2 to produce a first effluent stream 12.

The feedstock was contacted with a 1/32" Ni-ZSM-5 unsteamed extrudate dewaxing catalyst. The catalyst was prepared from a base of 65% ZSM-5 type zeolite mixed with 35% hydrated alumina (alpha alumina monohydrate). The base was then dried and calcined in $N_2$ at 1000° F. to decompose organic material. Then, the base was exchanged at room temperature with an aqueous solution of ammonium nitrate ($NH_2NO_3$) to reduce sodium levels in the zeolite to less than 500 ppm. This reduced sodium material was impregnated with nickel components by contact with an aqueous solution of nickel nitrate ($Ni(NO_3)_2.6H_2O$). The resulting composite was dried out and calcined at 1000° F. and the final product contained about 1.3 wt % nickel. The catalyst properties are listed in Table 2.

To start up the test reactor, the catalyst was sulfided with $H_2S$ from 450° to 650° F. The reactor was then lined out at 400° F. and then the catalyst was contacted with feedstock. Then, the temperature was raised in 10° F./hr (6° C./hr) increments until a 20° F. pour point effluent was produced. Afterwards, temperature was adjusted to maintain the 20° F. pour point specification. FIG. 3 plots the pour point of the first effluent stream, average reactor temperature (°F.), and LHSV versus days on stream. After lining out the bright stock to produce an effluent 12 with 10°–15° F. pour point, 15% 1-decene was co-fed with the bright stock as feedstock 2. The effluent 12 pour point increased drastically.

EXAMPLE 2

Example 2 was designed to show that the majority of the olefins are removed from a stream, such as the first reactor effluent stream 12, by separating a vapor stream employing a separating unit, such as the first separating unit 20. The tests were conducted in the same type test reactor disclosed in Example 1 and employed the feedstock disclosed in Table 3. The feedstock was contacted with a 1/16" Ni-ZSM-5 unsteamed extrudate dewaxing catalyst. The 1/16" catalyst was prepared in a similar manner as was the 1/32" catalyst of Example 1 and had the properties listed by Table 2. Prior to use in this example, the catalyst was employed in a commercial operation and then regenerated by oxidation to remove coke. The regenerated catalyst was placed into the test reactor of the present example and run with a bright stock and then the stock was switched to the light neutral stock of Table 3. The test reactor was then lined out at 655° F. and held constant for the balance of these tests. It is not believed that the prior runs of the catalyst interfere with the validity of the test results for this example, because the catalyst had been regenerated by oxidation before dewaxing bright stock and any loss in catalyst activity is accounted for by the reactor temperature and space velocities selected for this Example.

The test reactor represented the hydrodewaxing reactor 10 and was operated at a pressure of 400 psig, a hydrogen feed rate of 2500 SCF/bbl of product, and a range of LHSV from 4 to 0.5. FIG. 4 shows the olefinic contents of the various product cuts obtained from distilling the first effluent stream 12, plotted versus 1/LHSV of the test reactor. Comparing the olefinic contents of the total liquid product and lube fraction clearly indicates that almost all of the olefinic products occurred in the distillate (330° to 610° F.) and lighter fractions.

FIG. 5 shows the results of a commercial adiabatic reactor simulation and demonstrates the occurrence of a reactor temperature runaway in case of an operating upset, such as flow non-uniformity, when the dewaxing operation employs no separating units 10, 60. This simulation shows the temperature runaways which can occur if primary vapor by-products are not separated from a catalytic hydrodewaxing reactor effluent. The simulation conditions included a pressure of 400 psig, a LHSV of 1 $hr^{-1}$ and a hydrogen feed rate of 2500 SCF/bbl and the feedstock 2 was a typical light neutral stock having the properties described by Table 3. The simulation represents a feedstock 2 flowing through a single adiabatic reactor, with no vapor separation, to produce a 20° F. pour point product 38. The simulation divided the reactor into an outer annulus zone and a central zone, as shown in FIG. 5. The annulus zone has the same cross-sectional area as the central zone. The simulation assumes that only 20% of the oil throughput flows through the outer annulus zone, while 80% flows through the central zone.

FIG. 5 shows the effect of gas/liquid phase maldistribution and olefins on products. The reactions, namely endothermic cracking of wax to primary by-products, which include light olefins, and exothermic hydrogenation of the olefins, take time to develop but maldistribution is throughout. Thus, as the throughput proceeds along the fractional bed length of the reactor the reactions progress, causing the temperature differential between the annulus zone and the central zone to become more and more extreme. It would be more desirable to achieve the gradual temperature rise of perfect mixing, as simulated by the dashed line in FIG. 5 representing a well distributed flow. Hydrogenation of the olefinic products in the annulus zone can lead to a temperature rise of 135° F. when the majority of the oil phase flows through the central zone and a majority of the gas phase flows through the annulus zone. This large temperature rise would decrease the lube yield and degrade the lube product.

Hydrodewaxing hydrocarbons using reactors with intermediate separation of light products containing olefins, removes the olefinic products as they are formed during the course of the hydrodewaxing reaction. This simultaneously enhances the hydrodewaxing catalyst activity and controls reactor behavior. The enhanced catalyst activity results in a lower start-of-cycle temperature and a larger operating temperature span, thus resulting in a longer catalyst cycle life. The method and apparatus of FIG. 1 allows for a continuous process which takes advantage of all the benefits of two-stage dewaxing. The embodiment of FIG. 2 removes these olefinic products as they are formed during the course of the dewaxing reaction, as in the first embodiment, and routes them through an MOGDL unit to convert them into additional low pour high quality lube. This simultaneously enhances the dewaxing catalyst activity, increases the lube yield and insures a controlled reactor behavior. Furthermore, blending of the low pour MOGDL lube into the main lube product stream would reduce the requirement of dewaxing severity to meet a given target pour point.

While specific embodiments of the method and apparatus aspects of the invention have been shown and described, it should be apparent that many modifications can be made thereto without departing from the spirit and scope of the invention. Accordingly, the invention is not limited by the foregoing description, but is only limited by the scope of the claims appended thereto.

We claim:

1. A method for hydrodewaxing a hydrocarbon feedstock comprising the steps of:

(a) catalytically hydrodewaxing said feedstock by contact with a first intermediate pore crystalline zeolite catalyst under conditions sufficient to selectively convert waxy components comprising paraffins to produce a first effluent stream having an intermediate pour point of about 50° to about 70° F., wherein said first effluent stream comprises olefins;

(b) separating said first effluent stream to obtain a first vapor stream and a first liquid stream, said first liquid stream having an initial boiling point of at least 330° F., wherein said first vapor stream comprises a portion of said olefins; and (c) catalytically hydrodewaxing said first liquid stream by contact with a second intermediate pore crystalline zeolite catalyst under conditions sufficient to selectively convert waxy components comprising paraffins to produce a second effluent stream having a pour point less than about 30° F.

2. The method of claim 1, wherein said feedstock hydrodewaxing occurs at a temperature in the range from about 400° to about 800° F., a pressure in the range from about 100 to about 2000 psig, and a hydrogen feed rate in the range from about 500 to about 100,000 SCF/bbl of said feedstock;

said hydrodewaxing of said first liquid stream occurs at a temperature from about 400° F. to about 800° F., a pressure from about 100 to about 2000 psig and a hydrogen feed rate from about 500 to about 100,000 SCF/bbl of said first liquid stream; and wherein the overall space velocity for said feedstock hydrodewaxing step and said first liquid stream hydrodewaxing step is from about 0.25 to about 4.0 $hr^{-1}$ LHSV and the ratio of space velocity for hydrodewaxing said feedstock to that of hydrodewaxing said first liquid stream is from about 1:9 to about 9:1.

3. The method of claim 2, wherein said second effluent stream has a pour point less than about 20° F.

4. The method of claim 3, wherein said feedstock hydrodewaxing occurs at a temperature from about 500° to about 675° F., a pressure from about 350 to about 650 psig, and a hydrogen feed rate from about 1500 to about 4000 SCF/bbl of said feedstock;

said first liquid stream hydrodewaxing occurs at a temperature from about 500° to about 675° F., a pressure from about 350 to about 650 psig and a hydrogen feed rate from about 1500 to about 4000 SCF/bbl of said first liquid stream; and said overall space velocity for said feedstock hydrodewaxing and said first liquid stream hydrodewaxing is from about 0.5 to about 1.0 $hr^{-1}$ LHSV and the ratio of space velocity for hydrodewaxing said feedstock to hydrodewaxing said first liquid stream is from about 3:7 to about 7:3.

5. The method of claim 1, wherein said first crystalline zeolite dewaxing catalyst comprises a hydrogenation component and said second crystalline zeolite dewaxing catalyst comprises a hydrogenation component.

6. The method of claim 1, wherein said first and second intermediate pore zeolite catalysts have the structure of at least one zeolite from the group consisting of ZSM-5, ZSM-11, ZSM-23, ZSM-35, ZSM-38, ZSM-48 and TMA Offretite.

7. The method of claim 1, wherein said first liquid stream has an initial boiling point of at least 610° F.

8. The method of claim 7, wherein said first vapor stream comprises 610° F.⁻—b.p. hydrocarbons, and said first liquid stream has an initial boiling point ranging between 610° and 800° F.

9. The method of claim 1, further comprising the step of hydrotreating said second effluent stream to produce a hydrotreated effluent stream and separating said hydrotreated effluent stream to recover a lube product.

10. The method of claim 9, wherein said separation of said hydrotreated effluent forms a first recycle $H_2$ stream and portions of said first recycle $H_2$ stream are combined with said feedstock and said first liquid stream.

11. The method of claim 1, further comprising the steps of separating a recycle stream from said first liquid stream and combining said recycle stream and said feedstock prior to said catalytic hydrodewaxing step.

12. The method of claim 7, further comprising the step of catalytically oligomerizing said olefins from said first vapor stream to produce lube range hydrocarbons.

13. The method of claim 12, further comprising the step of separating said second effluent stream to obtain a second vapor stream and a second liquid stream.

14. The method of claim 13, wherein said second liquid stream has an initial boiling point of at least 610° F.

15. The method of claim 14, wherein said second vapor stream comprises 610° F.⁻—b.p. hydrocarbons, and said first liquid stream has an initial boiling point ranging between 610° and 800° F.

16. The method of claim 14, wherein said second vapor stream comprises olefins and further comprising the step of catalytically oligomerizing said second vapor stream olefins, thereby producing said lube range hydrocarbons.

17. The method of claim 16, wherein said oligomerization occurs at a temperature from about 350° F. to about 600° F., a pressure from about 100 psig to about 3000 psig and a space velocity from about 0.1 to about 5.0 $hr^{-1}$ LHSV.

18. The method of claim 16, wherein said lube range hydrocarbons from said catalytic oligomerization step are combined with said second liquid stream to produce a hydrocarbon stream having a pour point less than about 30° F.

19. The method of claim 12, wherein a second recycle hydrogen stream is obtained from said catalytic oligomerization step and portions of said recycle stream are combined with said feedstock and said first liquid stream.

20. The method of claim 12, further comprising the steps of separating a recycle stream from said first liquid stream and combining said recycle stream and said feedstock prior to said catalytic hydrodewaxing step.

21. A method for hydrodewaxing a hydrocarbon feedstock comprising the steps of:

(a) catalytically hydrodewaxing said feedstock at a temperature in the range from about 500° to about 675° F., a pressure from about 350 to about 650 psig, and a hydrogen feed rate from about 1500 to about 4000 SCF/bbl of said feedstock to selectively convert waxy components comprising paraffins to produce a first effluent stream having an intermediate pour point of about 50° to about 70° F.;

(b) separating said first effluent stream to obtain a first vapor stream comprising 610° F.⁻ b.p. hydrocarbons, a portion of which are olefinic, and obtain a first liquid stream comprising hydrocarbons having an initial boiling point ranging from 610° to 800° F.;

(c) catalytically hydrodewaxing said first liquid stream at a temperature in the range from about 500° to about 675° F., a pressure from about 350 to about 650 psig and a $H_2$ treat rate from about 1500 to about 4000 SCF/bbl of said first liquid stream to selectively convert waxy components comprising paraffins to produce a second effluent stream having a pour point less than about 20° F.;

(d) hydrotreating said second effluent stream to produce a hydrotreating effluent stream and separating said hydrotreated effluent stream to form a lube product;

wherein said overall space velocity for said feedstock hydrodewaxing and said first liquid stream hydrodewaxing steps is from about 0.5 to about 1.0 $hu^{-1}$ LHSV and the ratio of space velocity for hydrodewaxing said feedstock to hydrodewaxing said first liquid stream is about 3:7 to about 7:3; and wherein said feedstock hydrodewaxing step and said first liquid stream hydrodewaxing step comprise contacting said respective streams with respective crystalline zeolite dewaxing catalysts having the structure of ZSM-5.

* * * * *